US007234220B1

(12) United States Patent
Grace, Jr.

(10) Patent No.: US 7,234,220 B1
(45) Date of Patent: Jun. 26, 2007

(54) METHOD OF MANUFACTURING A SLIDING BLADE BROADHEAD

(76) Inventor: Louis Grace, Jr., 34775 Potter St., Memphis, MI (US) 48041

( * ) Notice: Subject to any disclaimer, the term of this patent is extended or adjusted under 35 U.S.C. 154(b) by 0 days.

(21) Appl. No.: 11/220,946

(22) Filed: Sep. 7, 2005

Related U.S. Application Data

(60) Provisional application No. 60/607,428, filed on Sep. 7, 2004.

(51) Int. Cl.
*F42B 6/08* (2006.01)
*B23P 11/00* (2006.01)

(52) U.S. Cl. ..... 29/428; 29/434; 29/557; 473/583

(58) Field of Classification Search ..... 29/428, 29/434, 525, 557, 558, 451; 473/582, 583, 473/584

See application file for complete search history.

(56) References Cited

U.S. PATENT DOCUMENTS 5,820,498 A * 10/1998 Maleski ..... 473/584
5,879,252 A * 3/1999 Johnson ..... 473/583
6,290,903 B1 9/2001 Grace, Jr. et al.
6,669,586 B2 * 12/2003 Barrie et al. ..... 473/583
6,749,801 B1 6/2004 Grace, Jr. et al.
6,793,596 B1 * 9/2004 Sullivan et al. ..... 473/583
6,935,976 B1 8/2005 Grace, Jr. et al.
2003/0004021 A1 * 1/2003 Barrie et al. ..... 473/583
2003/0153417 A1 * 8/2003 Barrie et al. ..... 473/583

* cited by examiner

*Primary Examiner*—Jermie E. Cozart
(74) *Attorney, Agent, or Firm*—Steve M. Clemmons; Charles W Chandler

(57) ABSTRACT

The present invention provides a mechanical broadhead in which the blades slide within longitudinal channels that are formed in the ferrule. The blade is formed having a transverse boss extending from the flanks which are received in a channel formed in the ferrule. A camming surface is formed on the inward edge of the blades cooperate with a compliant member to provide controlled radial movement of the blades as they slide rearwardly within the channel on the ferrule.

21 Claims, 8 Drawing Sheets

METHOD OF MANUFACTURING A SLIDING BLADE BROADHEAD

CROSS-REFERENCE TO RELATED APPLICATION

This application claims priority of Provisional Patent Application filed Sep. 7, 2004, Ser. No. 60/607,428 SLIDING BROADHEAD—RETENTION AND RELEASE MECHANISM AND METHODS OF MANUFACTURE.

BACKGROUND OF THE INVENTION

A mechanical or expanding-blade broadhead is a type of broadhead in which the blades are operably coupled to the ferrule in a manner to move from an in-flight, retracted position to an on-impact, deployed position. This configuration of a broadhead is beneficial in that it has flight characteristics similar to those of a field point tip and penetration characteristics similar to those of a fixed blade broadhead.

The design of these broadheads generally are of two types; those that pivot to the deployed position about a point toward the rear of the ferrule, and those that slide to the deployed position along a path essentially parallel to the axis of the ferrule.

The present invention relates generally to mechanical expanding blade broadheads, specifically those in which the blades slide in relation to the ferrule, to alternative configurations of the broadhead components and to their method of manufacture.

Reference is hereby made to the second of the above referenced types of mechanical broadheads as disclosed in U.S. Pat. No. 6,935,976 of the present inventor, the disclosure of which is expressly incorporated by reference herein.

The sliding blade-type of mechanical broadhead includes one or more blades which slide longitudinally relative to the ferrule from the in-flight, retracted position to the on-impact deployed position. Specifically, the blades in this sliding-type mechanical broadhead are disposed within a longitudinal groove formed in the ferrule such that the cutting edge of the blades extend radially outwardly. A retaining projection extends from the bottom of the blade and slides within the channel. During flight, the blades are closely positioned to the ferrule, and upon impact the blades slide rearwardly through a range of motion defined by the groove to the deployed position.

These current designs of sliding blade-type mechanical broadheads do provide the beneficial features of field point flight characteristics and the penetration capability similar to a fixed blade broadhead. However, the highly detailed features of these type of broadheads require specialized molds and manufacturing techniques, such as Metal Injection Molding (MIM) or powdered metallurgical technology. Further, prior art sliding blade broadheads often have complicated mechanisms to retain the blades in their in-flight and post-impact positions. Further still, broadheads, such as the ones disclosed in the above referenced patent, typically have the point integrally formed with the ferrule and do not allow for interchangeable broadhead points. Additionally, these sliding blade designs may have an undesirable amount of friction at the point where the blade slides along the channel due to the metal on metal arrangement.

The present invention provides for a broadhead and methodology that forms a sliding blade broadhead that overcomes all of the above stated drawbacks.

SUMMARY OF THE INVENTION

The present invention is directed to a mechanical broadhead and a method of manufacturing a mechanical broadhead in which a set of blades are operably coupled to the ferrule to slide within a longitudinal channel formed therein from an in-flight, retracted position to an on-impact deployed position. Specifically, each blade has a boss extending from a flank of the blade. The channel formed in the ferrule is complimentary with the boss such that the blade freely slides within the channel. A notch formed on the front surface of the blade retains the blade in the retracted or in-flight position. An O-ring is disposed on the ferrule across the channel and operates to retain the blades within the channel, provides a surface to allow the blades to deploy against, and frictionally hold the blades in the deployed or on-impact position. The present invention further provides for the manufacture of sliding blade broadheads having removable points and low friction bosses.

A first advantage of the present invention is that it is directed to a sliding-type mechanical broadhead in which the blades of the broadhead have an O-ring that cooperates with a blade which is received within a channel formed in the ferrule to operably retain the blade within the ferrule.

Another advantage of the present invention is to provide a sliding blade broadhead having blades with a notch which cooperates with the front of the ferrule to retain the blades in a retracted in-flight position.

Yet another advantage of the present invention is to provide an improved design for a sliding-type mechanical broadhead in which the broadhead's point may be readily replaced.

Yet still another advantage of the present invention is directed to a sliding-type mechanical broadhead in which the boss is formed from a low friction material.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 9:
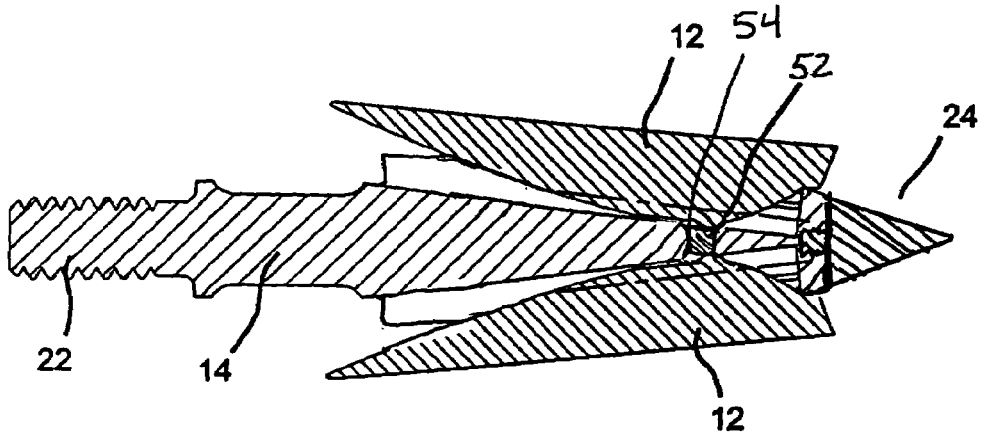
FIG. 9 is a cross-section view of a mechanical broadhead in accordance with a second preferred embodiment of the present invention in which a magnet is disposed within the ferrule of the broadhead.
Figure 10:
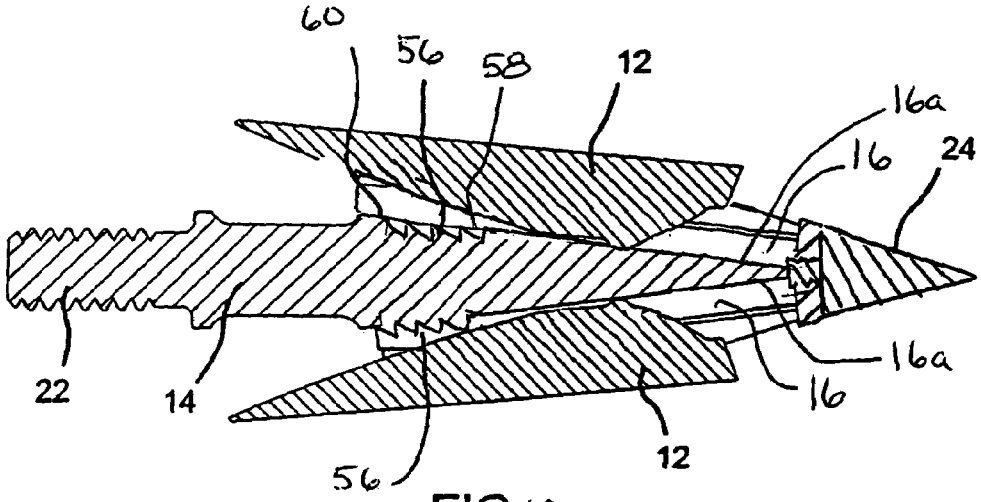
FIG. 10 is a cross-section of a mechanical broadhead having a plurality of serrated teeth along the bottom of the longitudinal channels which operate to retain the blades in the deployed position.

With reference to the Figures, a first preferred embodiment of the present invention is illustrated in FIGS. 1–8, a second preferred embodiment of the present invention is illustrated in FIG. 9 and a third preferred embodiment is illustrated in FIG. 10. Unless specifically noted, it will be understood that the three preferred embodiments share the same or similar features. The present invention is directed to a mechanical broadhead 10 having multiple blades 12 operably coupled to a ferrule 14 such that the blades 12 slide within a channel 16 formed longitudinally in the ferrule 14. Blades 12 are slidably positionable within channel 16 from an in-flight, retracted position to an on-impact, deployed position. The broadhead 10 is secured to an arrow shaft 18 through insert 20. As presently preferred, ferrule 14 has a shank portion 22 with an external thread formed thereon for releasably securing the ferrule 14 to the insert 20. A tip portion 24 is removably coupled to the ferrule 14 on the front portion 13 opposite the shank portion 22 to provide a cutting edge for broadhead 10. As illustrated in the figures, tip portion 24 is releasably secured to the body of the ferrule 14 through a conventional threaded arrangement. Tip portion 24 is a field tip having a generally conical shape which projects from the ferrule 14. While the present invention is illustrated with a field tip, one skilled in the art will recognize that a mechanical broadhead in accordance with the present invention could be provided with a variety of tip portions such as a trocar point or a hybrid-type point having a tapered nose with a pair of fixed cutting blades extending laterally over a portion of the ferrule 14.

Figure 1:
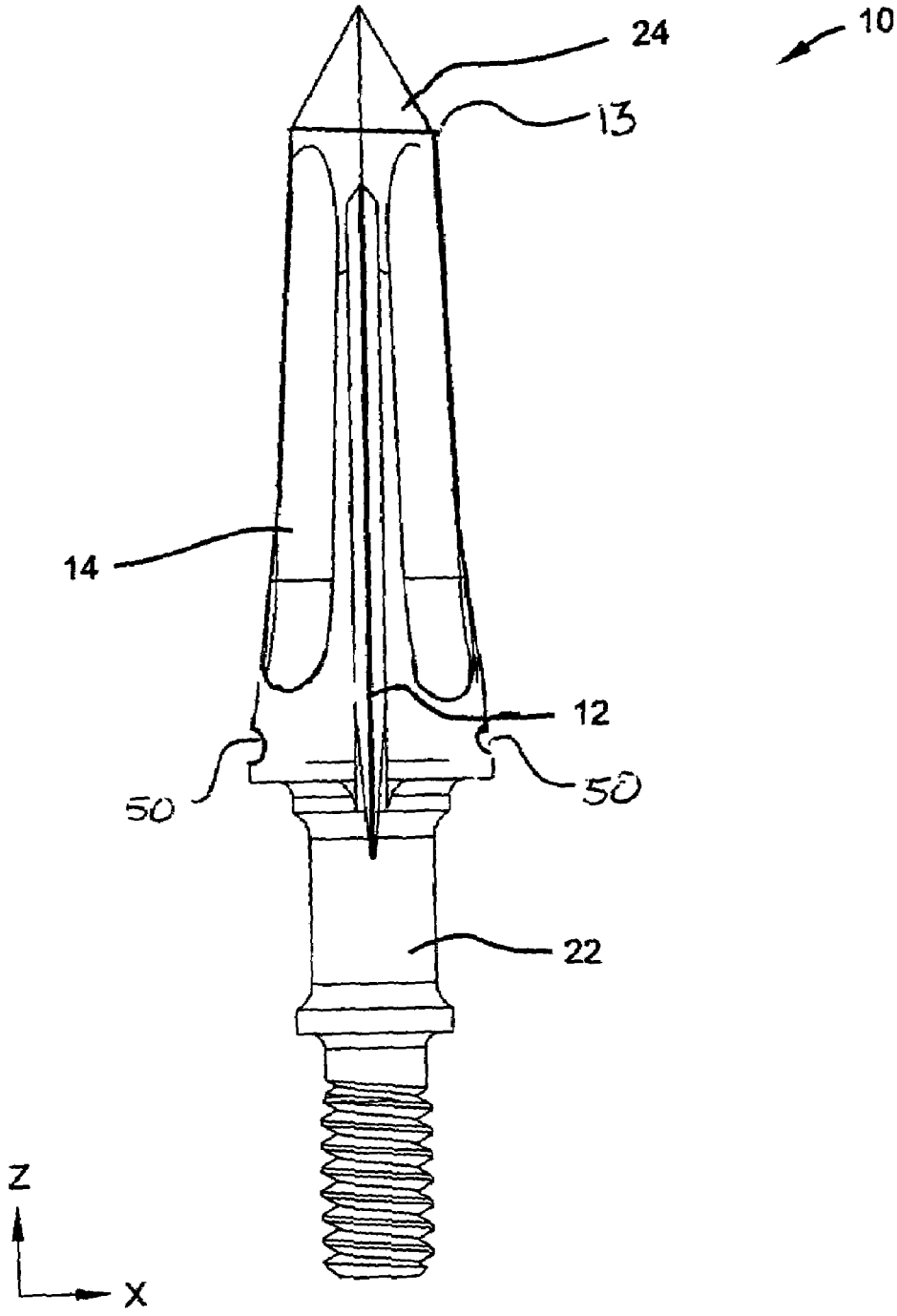
FIG. 1 is a top view of a mechanical broadhead in accordance with a first preferred embodiment of the present invention with the blades shown in a retracted position, the compliant retention member is omitted for clarity.
Figure 2:
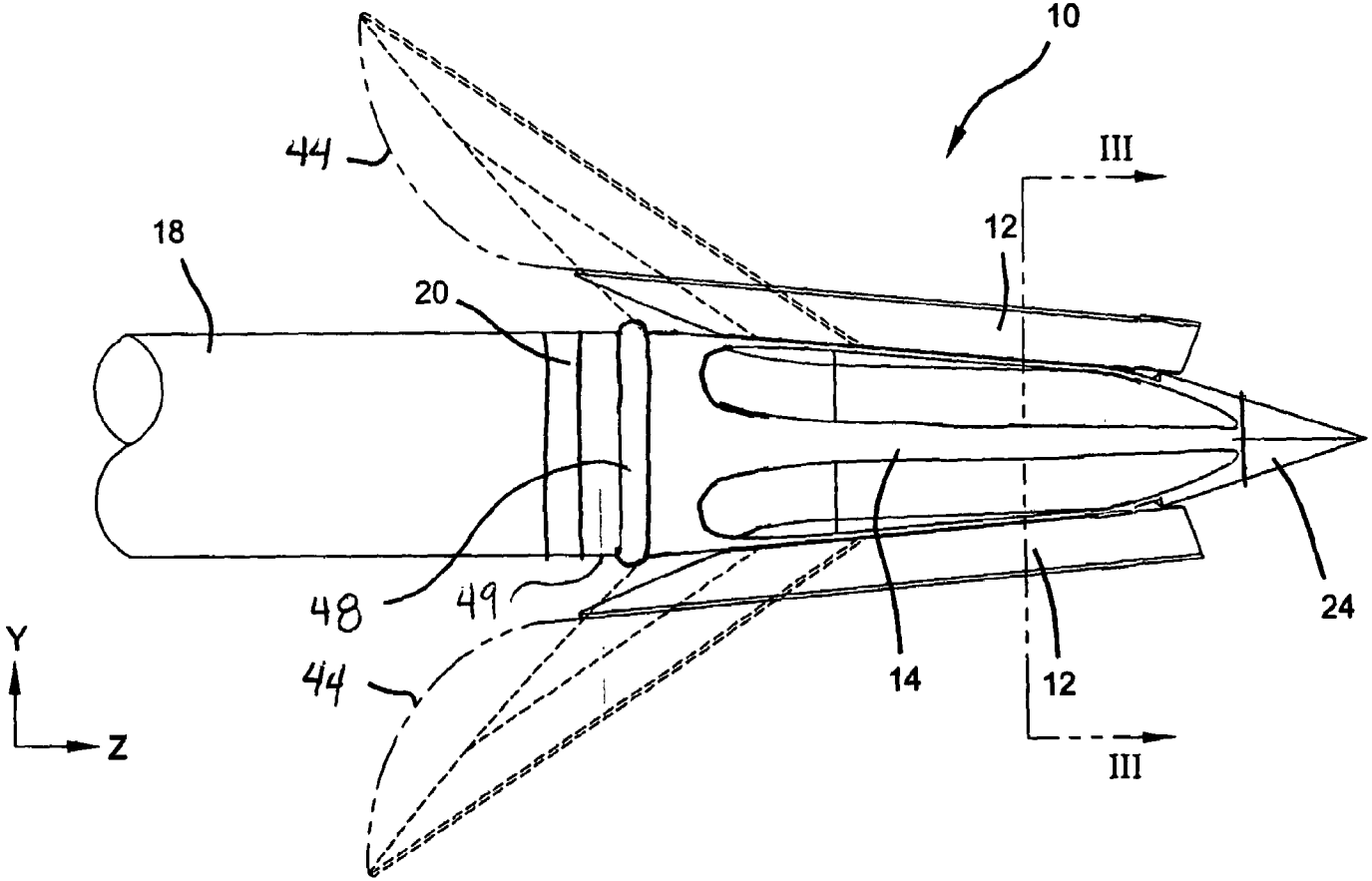
FIG. 2 is a side view of the broadhead illustrated in FIG. 1 with the blades shown in solid lines in the retracted position and broken lines in the deployed position.
Figure 3:
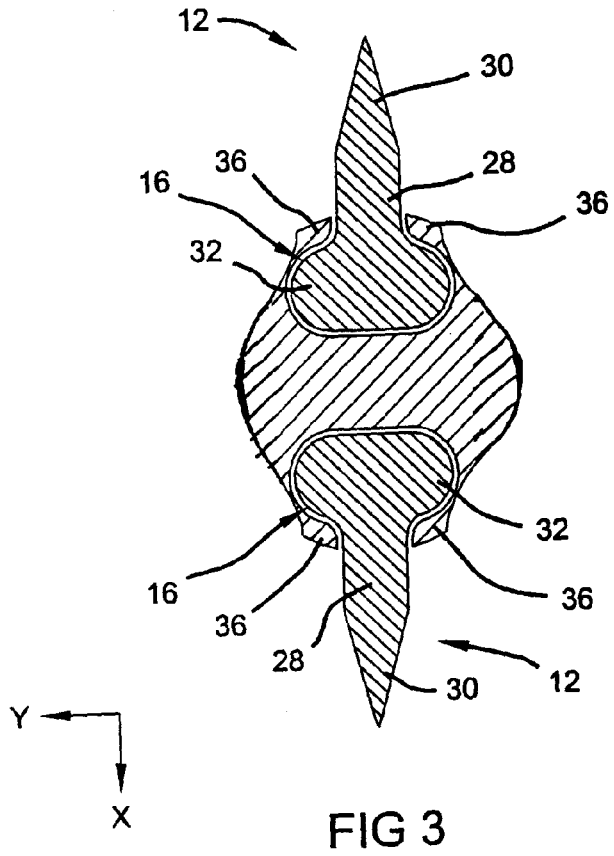
FIG. 3 is a transverse cross-section taken along line III—III shown in FIG. 2.
Figure 4:
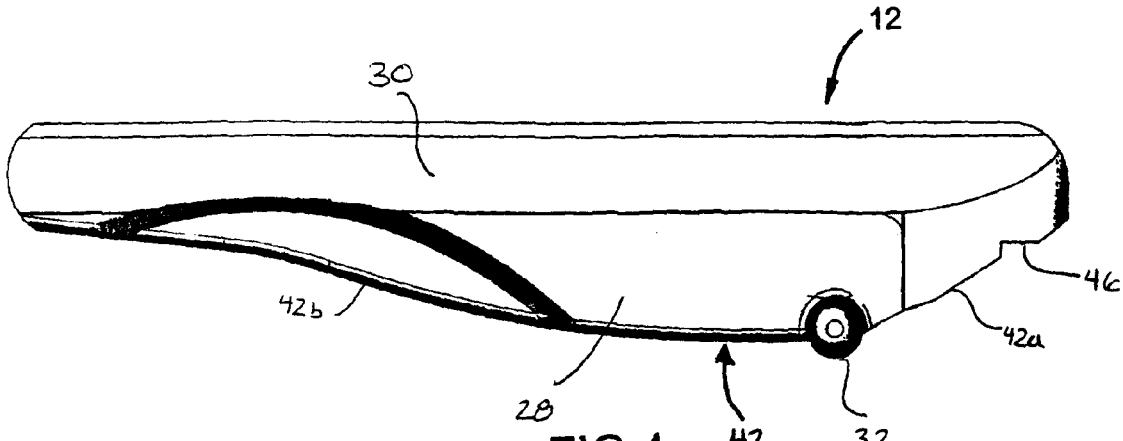
FIG. 4 is a side view of a blade shown in FIG. 2.

With reference now to FIGS. 3–4, each of the blades 12 have a generally planar flank portion 28 and a tapered edge portion 30 terminating at a sharpened edge. A boss 32 extends transversely from the planar flank 28 and is received within channel 16 to operably couple the blades 12 with the ferrule 14. Channel 16 has a geometry which is generally complementary of the boss 32 and a lip 36 which cooperates with the boss 32 to retain the blade 12 in the ferrule 14. The boss 32 and a portion of the blade flank 28 are received within the channel 16. In one embodiment, the boss 32 is integrally formed with the metal blade flank 28. In another embodiment, the boss 32 is made from a low-friction material such as plastic or ceramic. This boss 32 may be secured to the blade flank 28 through conventional fasteners, adhesives, or may be press fit to the flank 28.

In the preferred embodiment, a retainer is utilized to selectively retain the blades in channel 16. With reference now to FIGS. 1, 2, and 5–7, the first preferred embodiment includes a compliant element 48 disposed within a pair of semi-cylindrical grooves 50 formed on the back portion of the ferrule 14. Compliant element 48 functions as a stopping point across the channel 16 to retain the blades 12 in channel after impact and when the blades 12 are in the deployed position. The compliant element 48 may be formed from rubber or urethane and in the preferred embodiment is a rubber O-ring. In another embodiment, the compliant member 48 is a garter spring.

Compliant member 48 is located concentrically about the ferrule 14 and is retained in the grooves 50 in the ferrule 14. The blades 12 are first assembled to the ferrule 14 by inserting the bosses 32 into their respective channels 16. The Compliant member 48 is then slipped over the ferrule 14 and positioned in the retaining groove 50 in the ferrule 14. Upon impact, the rearward motion of the blades 12 causes the notch 46 to disengage the front portion 13 allowing the blades 12 to deploy following the travel path 44 generally illustrated in FIG. 2. As will be discussed in greater detail below, the rearward camming surface 42*b* of the blade 12 engages the Compliant member 48 as the blades 12 are being deployed (i.e., on-impact) to cause the blades 12 to follow the travel path 44 and expand.

A washer 49 is disposed adjacent to Compliant member 48 and provides support to the compliant member when the blades 12 are sliding along the compliant member during blade deployment. Washer 49 is sized to fit over shank 22 and abuts both the insert 20 and the rearward edge of the ferrule 14.

To facilitate sliding of the blade 12 relative to the ferrule 14, the height (x-direction) and width (y-direction) increase along the length (z-direction) from the tip 24 to the shank 22. In this manner, the channels 16 expand slightly in height and in width from a leading end to a trailing end of the ferrule 14 such that the blades 12 slide more freely as they move rearwardly. A relief in the form of an angular relief, a linear relief or a radial relief may also be provided on the lip 36 to promote free sliding movement of the blades 12 within the channels 16.

As best seen in FIG. 3, the boss 32 is configured as a hemispherical extension which provides a smooth interface within the channel 16 which has a generally elliptical groove. However, one skilled in the art will recognize that the configuration of the boss 32 and the channel 16 may take any suitable form which provides a smooth interface to promote relative sliding movement therebetween.

With particular reference to FIG. 4, each blade 12 has a camming surface 42 formed on the blade opposite edge portion 30. A forward portion 42*a* of the camming surface cooperates with the channel 16 to control the cutting diameter (i.e., the distance between the rear tips of the blades 12) in the deployed position. A rearward portion 42*b* of the camming surface 42 extending rearwardly of the boss 32 cooperates with the Compliant member 48 to rotate the blades 12 outwardly as they slide longitudinally rearwardly within the ferrule 14. Thus, the forward and rearward portions 42*a*, 42*b* of the camming surface define a blade travel path 44.

Figure 5:
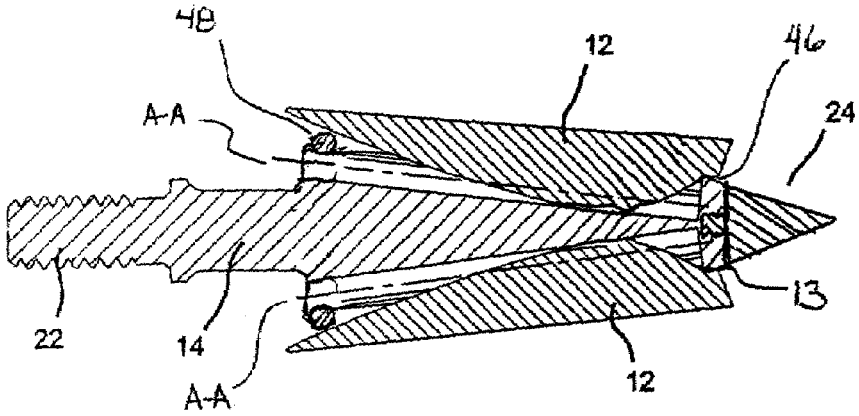
FIG. 5 is a cross-section of the broadhead of FIG. 1 in which the blades are shown in the retracted position.

The blades 12 also include another feature to enhance the functions of the mechanical broadhead. With reference to the first preferred embodiment, a notch 46 is formed at the end of forward camming portion 42*a* and functions to limit the blades 12 ability to pivot about the boss 32 when in the retracted position. The notch 46 operates to retain the blades 12 in the retracted in-flight position. For example, as best seen in FIG. 5, the notch 46 engages the front portion 13 of the ferrule 14 and the tip portion 24 to achieve this limiting function. One skilled in the art will recognize that the edge portion 30 of the blades 12 are configured to provide sufficient frontal area to engage a target upon impact and initiate the rearward movement of the blades 12 relative the ferrule 14. The blades 12 may also be provided with pockets or windows (not shown) such that the weight and rotational inertia of the blade may be precisely tuned.

Figure 6:
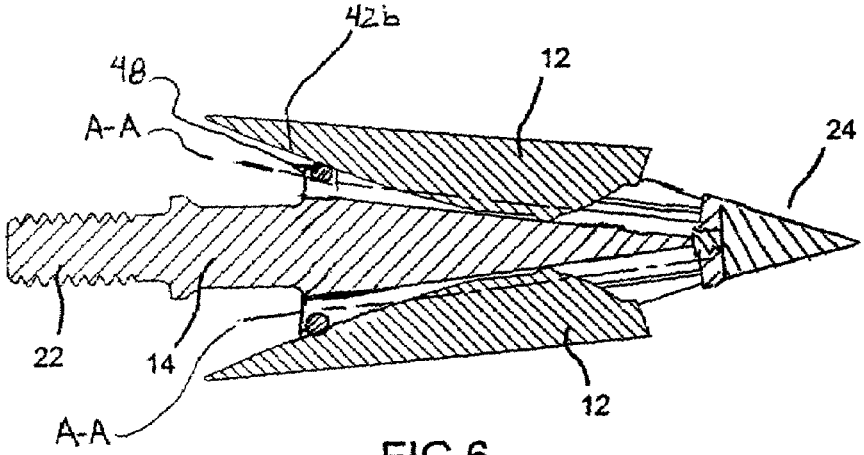
FIG. 6 is a cross-section similar to FIG. 5 in which the blades are shown in a partially deployed position.
Figure 7:
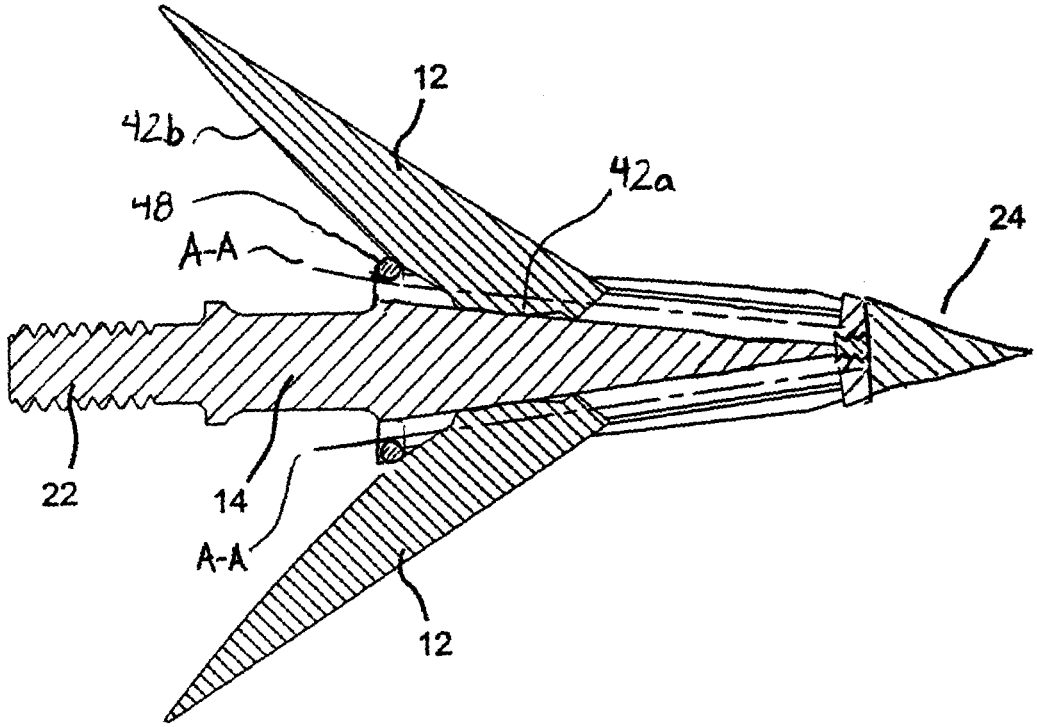
FIG. 7 is a cross-section similar to FIG. 5 in which the blades are shown in the fully deployed position.
Figure 8:
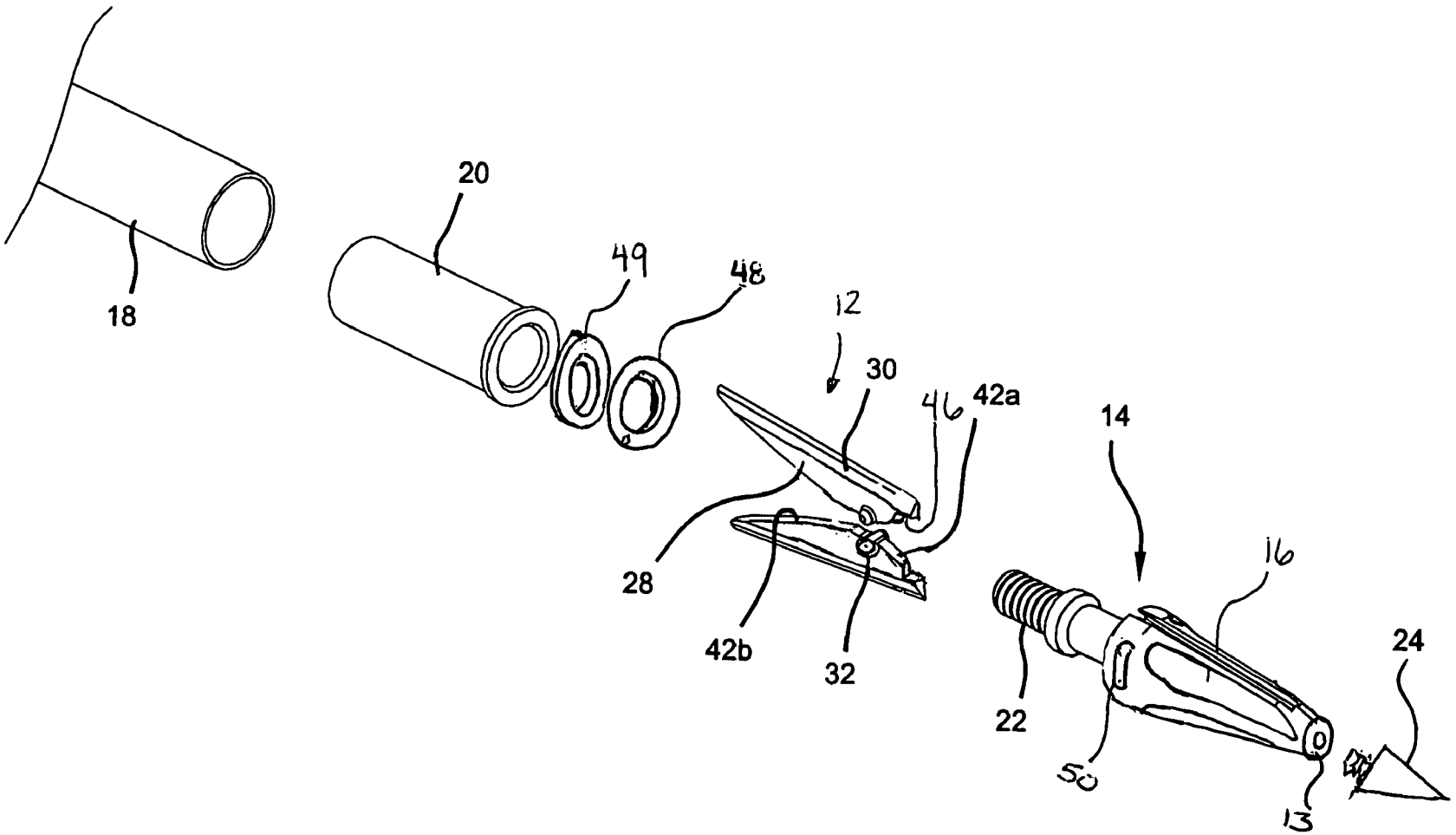
FIG. 8 is an exploded perspective view of a mechanical broadhead in accordance with the first preferred embodiment of the present invention.

As presently preferred, the geometry of the blades 12 is such that travel within the channel 16 is initially generally parallel to the longitudinal axis A—A of channels 16 formed in the ferrule 14 until the rear camming surface 42*b* engages the compliant member 48. At this point the camming surface 42*b* engages the compliant member such that the blades 12 rotate outwardly as they slide rearwardly in channel 16. The blade travel path described above is illustrated with phantom lines in FIG. 2 and will be more fully appreciated from a comparison of FIGS. 5–7 showing the blades 12 retracted, partially deployed and fully deployed, respectively. As shown in FIG. 7, when the blades 12 are in the fully deployed position, the compliant member 48 and bottom surface 16*a* of the channel 16 cooperate to frictionally hold the blades 12 in the deployed position. That is, the rearward camming surface 42*b* is frictionally retained by the compliant member 48, while the forward camming surface 42 abuts the bottom surface 16*a*.

With reference now to FIG. 9, a second preferred embodiment is illustrated which utilizes a magnet 52 that is disposed within channel 16. Magnet 52 functions as a retaining element within the channel 16 to create a small magnetic attraction to the blade 12, thereby retaining it in the in-flight, retracted position. As presently preferred, the magnet 52 is disposed within a small recessed section 54 formed in the channel 16 and provides slight resistance to rearward sliding movement of the blade 12 in the channel 16.

In an third preferred embodiment, shown in FIG. 10, the bottom surface 16*a* of channel 16 is not smooth as described above, but instead includes a plurality of ridges or teeth 56. Teeth 56 operate to retain the blade 12 in the post-impact or deployed position. Teeth 56 are tapered rearwardly in the channel 16 in a manner which allows the blade 12 to slide back along channel 16 with little or no resistance, but resist the blade 12 from sliding forward. In the preferred embodiment, each depression 58 is sized to allow the boss 32 to drop or settle slightly between adjacent teeth 56. As shown, the teeth 56 may be disposed only along a section of the channel 16 that is in proximity to the rearward wall 60 (i.e., when the blade 12 is in the fully-deployed position) or may be formed along the entire length of the channel 16.

Figure 11:
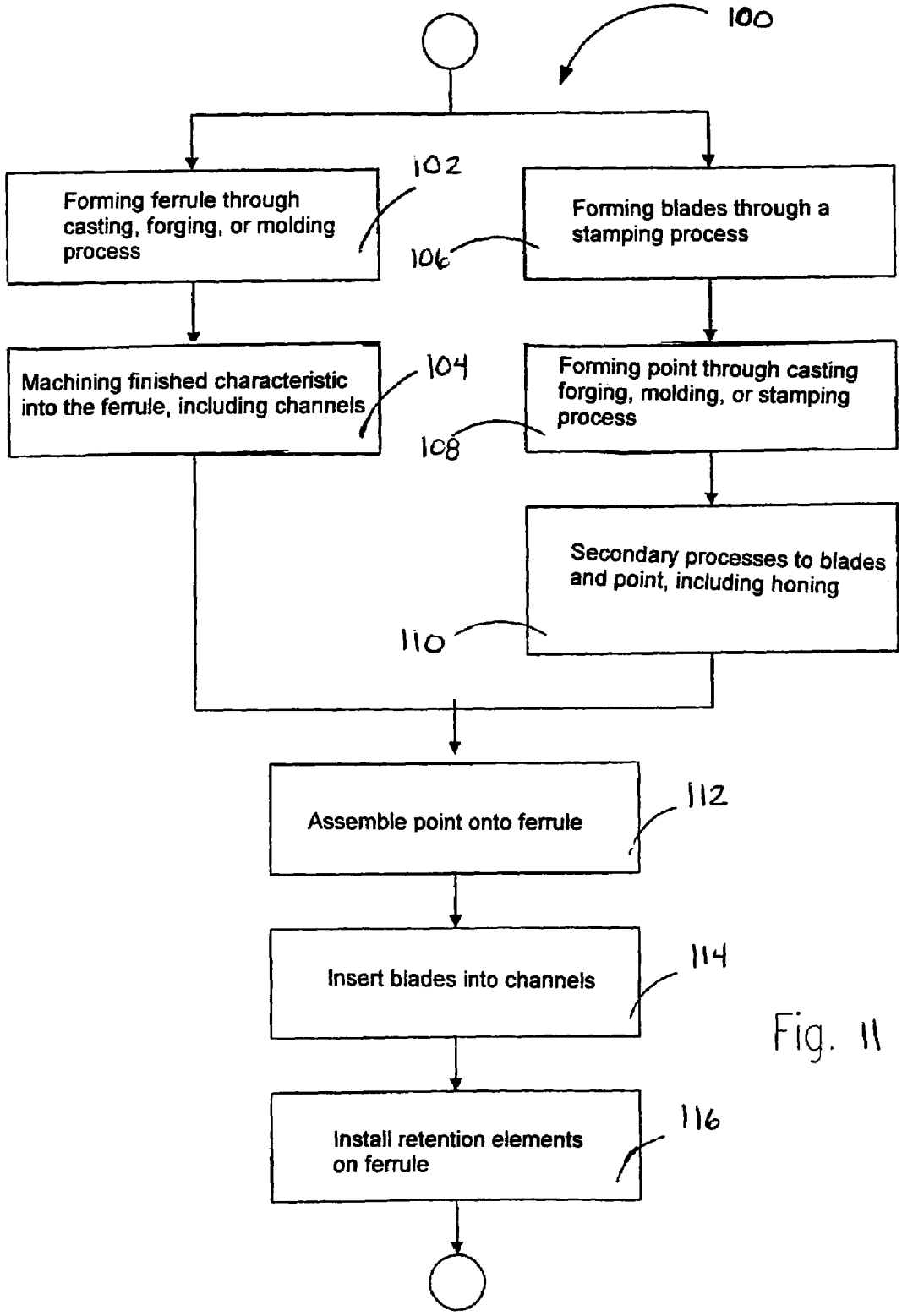
FIG. 11 is a flow chart illustrating the method of manufacturing a sliding blade mechanical broadhead according to a preferred embodiment.

With reference now to FIG. 11, a method of manufacturing the above-described sliding blade broadhead in accordance with the present invention will now be described. The method of manufacture is schematically illustrated in flow chart 100. As represented in block 102, a rough or unfinished ferrule is formed through a casting, forging, or molding process. Next, as represented in block 104, the rough ferrule is finished through at least one machining process in which the channels 16 are formed along the ferrule and the ferrule is threaded to allow coupling to an insert 20 and point 24. Retention element retaining grooves 50 are also formed at this time into the ferrule. Channels 16 and grooves 50 are formed in the ferrule through milling or through electrical discharge machining process.

As represented in block 106, the blades 12 are formed through a stamping process where a metal blank is pressed by die having the finished characteristics of the blade 12. In one preferred embodiment, blade 12 is produced through a conventional fine blanking stamping process. In one embodiment, the boss 32 is integrally formed in the blade 12 in this stamping operation. In another embodiment, the blade 12 is formed without a boss 32 and will be added in a secondary operation described below. Next, as represented in block 108, the point 24 is formed through a casting, forging, molding, or stamping process. Next, as represented in block 110, secondary operations are done to the blade 12 and point 24. These secondary operations include sharpening the blade 12 and point 24 through a honing process. In one embodiment, a boss 32 is coupled to the flank 28 through a conventional process such as using mechanical fasteners, adhesives, and/or through a press-fitting operation. In this embodiment, boss 32 may be formed from a different material than blade 12, such as plastic.

Next, as represented at block 112, the point 24 is assembled onto the ferrule 14. Next, as represented at block 114, the blades 12 are inserted into the longitudinal channels 16. Lastly, as represented at block 116, the retention element 48 is installed on the ferrule 14.

As noted above, the preferred embodiment of the present invention is illustrated to include a pair of blades 12 operably coupled to the ferrule 14 for sliding movement between the retracted and expanded positions. However, one skilled in the art will readily recognize that the present invention may be readily adapted to provide a broadhead having a configuration with any number of multiple blades as dictated by the specific application. Likewise, a particular design and shape of the ferrule including the tip portion may be modified as dictated by the specific application. For example, the embodiment illustrated in the drawings presently contemplates an 85 grain broadhead; however, the ferrule 14 may be reconfigured to provide a heavier or lighter broadhead, depending on the intended application. The present invention has been described with reference to several preferred embodiments having many common and some distinct features. One skilled in the art will recognize that these features may be used singularly or in any combination based on the requirements and specifications of a given application or design.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of manufacturing a sliding blade broadhead comprising the steps of:

forming a ferrule having a longitudinal channel and a retention groove;

providing a blade having a forward retention notch and a boss which extends transversely from said blade;

inserting said blade into said channel whereby said boss is received in said channel for coupling said blade to said ferrule for relative sliding movement within said channel from a retracted position to a deployed position, wherein said notch cooperates with said ferrule to retain said blade in a retracted position;

disposing a compliant retention member within said retention groove concentric to said ferrule, whereby said compliant retention member transversely crosses said channel and operates to retain said blade within said channel; and removably coupling a broadhead point to a front portion of said ferrule.

2. The method of manufacturing a sliding blade broadhead of claim 1 wherein the step of coupling a broadhead point to said ferrule comprises the step of forming complementary threaded portions on said ferrule and said broadhead point.

3. The method of manufacturing a sliding blade broadhead of claim 1 wherein the step of forming said ferrule comprises metal injection molding said ferrule.

4. The method of manufacturing a sliding blade broadhead of claim 1 wherein the step of forming said ferrule includes the step of machining said channel from said ferrule.

5. A method of manufacturing a sliding blade broadhead comprising the steps of:

forming a ferrule having a longitudinal channel and a retention groove;

stamping a metal blank with a die to form a blade having a forward retention notch and a boss which extends transversely from said blade, whereby said boss is integrally formed within said blade;

inserting said blade into said channel whereby said boss is received in said channel for coupling said blade to said ferrule for relative sliding movement within said channel from a retracted position to a deployed position, wherein said notch cooperates with said ferrule to retain said blade in a retracted position;

disposing a compliant retention member within said retention groove concentric to said ferrule, whereby said compliant retention member transversely crosses said channel and operates to retain said blade within said channel.

6. The method of manufacturing a sliding blade broadhead of claim 5 further comprising the step of removably coupling a broadhead point to a front portion of said ferrule.

7. The method of manufacturing a sliding blade broadhead of claim 5 wherein the step of forming said ferrule comprises metal injection molding said ferrule.

8. The method of manufacturing a sliding blade broadhead of claim 5 wherein the step of forming said ferrule includes the step of machining said channel from said ferrule.

9. A method of manufacturing a sliding blade broadhead comprising the steps of:

forming a ferrule having a longitudinal channel and a retention groove;

providing a blade having a cutting edge portion and a flank portion, said flank portion having a forward retention notch;

coupling a plastic boss to said flank portion, wherein said boss extends transversely from said blade;

inserting said blade into said channel whereby said boss is received in said channel for coupling said blade to said ferrule for relative sliding movement within said channel from a retracted position to a deployed position, wherein said notch cooperates with said ferrule to retain said blade in a retracted position; and disposing a compliant retention member within said retention groove concentric to said ferrule, whereby said compliant retention member transversely crosses said channel and operates to retain said blade within said channel.

10. The method of manufacturing a sliding blade broadhead of claim 9 wherein the step of coupling a plastic boss to said flank portion comprises the step of pressing said plastic boss onto said flank portion.

11. The method of manufacturing a sliding blade broadhead of claim 9 further comprising the step of removably coupling a broadhead point to a front portion of said ferrule.

12. The method of manufacturing a sliding blade broadhead of claim 9 wherein the step of forming said ferrule comprises metal injection molding said ferrule.

13. The method of manufacturing a sliding blade broadhead of claim 9 wherein the step of forming said ferrule includes the step of machining said channel from said ferrule.

14. A method of manufacturing a sliding blade broadhead comprising the steps of:

forming a ferrule having a longitudinal channel and a retention groove;

providing a blade having a forward retention notch and a boss which extends transversely from said blade;

inserting said blade into said channel whereby said boss is received in said channel for coupling said blade to said ferrule for relative sliding movement within said channel from a retracted position to a deployed position, wherein said notch cooperates with said ferrule to retain said blade in a retracted position;

disposing a compliant retention member within said retention groove concentric to said ferrule, whereby said compliant retention member transversely crosses said channel and operates to retain said blade within said channel; and inserting a magnet within said channel operating to magnetically attract said blade for releasably maintaining said blade in said retracted position.

15. The method of manufacturing a sliding blade broadhead of claim 14 further comprising the step of removably coupling a broadhead point to a front portion of said ferrule.

16. The method of manufacturing a sliding blade broadhead of claim 14 wherein the step of forming said ferrule comprises metal injection molding said ferrule.

17. The method of manufacturing a sliding blade broadhead of claim 14 wherein the step of forming said ferrule includes the step of machining said channel from said ferrule.

18. A method of manufacturing a sliding blade broadhead comprising the steps of:

forming a ferrule having a longitudinal channel and a retention groove, wherein teeth are formed in the channel that outwardly taper from a leading end to a trailing end;

providing a blade having a forward retention notch and a boss which extends transversely from said blade;

inserting said blade into said channel whereby said boss is received in said channel for coupling said blade to said ferrule for relative sliding movement within said channel from a retracted position to a deployed position, wherein said notch cooperates with said ferrule to retain said blade in a retracted position; and disposing a compliant retention member within said retention groove concentric to said ferrule, whereby said compliant retention member transversely crosses said channel and operates to retain said blade within said channel; and wherein said teeth cooperate with a camming surface on said blade to retain said blade in said deployed position.

19. The method of manufacturing a sliding blade broadhead of claim 18 further comprising the step of removably coupling a broadhead point to a front portion of said ferrule.

20. The method of manufacturing a sliding blade broadhead of claim 18 wherein the step of forming said ferrule comprises metal injection molding said ferrule.

21. The method of manufacturing a sliding blade broadhead of claim 18 wherein the step of forming said ferrule includes the step of machining said channel from said ferrule.

* * * * *